US010988980B2

(12) United States Patent
Chou

(10) Patent No.: US 10,988,980 B2
(45) Date of Patent: Apr. 27, 2021

(54) BLIND CORD GUIDE SEAT

(71) Applicant: Tser Wen Chou, Yorba Linda, CA (US)

(72) Inventor: Tser Wen Chou, Yorba Linda, CA (US)

( * ) Notice: Subject to any disclaimer, the term of this patent is extended or adjusted under 35 U.S.C. 154(b) by 225 days.

(21) Appl. No.: 16/372,211

(22) Filed: Apr. 1, 2019

(65) Prior Publication Data

US 2020/0071993 A1 Mar. 5, 2020

(30) Foreign Application Priority Data

Aug. 31, 2018 (TW) ..... 107211982

(51) Int. Cl.

| | |
|---|---|
| ***E06B 9/322*** | (2006.01) |
| ***E06B 9/304*** | (2006.01) |
| ***E06B 9/323*** | (2006.01) |
| *E06B 9/262* | (2006.01) |

(52) U.S. Cl.

CPC ..... *E06B 9/322* (2013.01); *E06B 9/323* (2013.01); *E06B 9/262* (2013.01); *E06B 9/304* (2013.01); *E06B 2009/2622* (2013.01); *E06B 2009/3225* (2013.01)

(58) Field of Classification Search

CPC ..... E06B 9/266; E06B 9/322; E06B 9/327; E06B 9/262; E06B 2009/3225; E06B 9/2622; E06B 9/382; E06B 9/40; E06B 9/42; E06B 9/304; E06B 9/323; E06B 2009/2622

See application file for complete search history.

(56) References Cited

U.S. PATENT DOCUMENTS

| | | | | |
|---|---|---|---|---|
| 3,605,852 A * | 9/1971 | Vecchiarelli | ..... | E06B 9/322 160/168.1 R |
| 5,042,553 A * | 8/1991 | Schaffer | ..... | E06B 9/323 160/178.1 R |
| 6,491,085 B1 * | 12/2002 | Anthony | ..... | E06B 9/262 160/168.1 V |

(Continued)

FOREIGN PATENT DOCUMENTS

| | | | | |
|---|---|---|---|---|
| EP | 0491096 A1 * | 6/1992 | ..... | E06B 9/323 |
| WO | WO-03080979 A2 * | 10/2003 | ..... | E06B 9/42 |

OTHER PUBLICATIONS

U.S. Appl. No. 15/890,282, Tser Wen Chou.
U.S. Appl. No. 15/890,282, filed Feb. 6, 2018; Tser Wen Chou.

*Primary Examiner* — Phi D A
(74) *Attorney, Agent, or Firm* — Guice Patents PLLC

(57) ABSTRACT

A blind cord guide seat includes a connection seat fixed under a blind rail and a cord restriction seat connected under the connection seat. The cord restriction seat includes a fixing section and a latch section. An outer face of each of the fixing section and the latch section is formed with a belt guide channel. The top end of the fixing section is formed with threaded holes for connecting with the connection seat by screws. When assembled with a cord winding device, an external force is applied to the latch section to outward bias the latch section to provide an opening for placing the cord winding device through the opening into the cord restriction seat. An iron-made hook bracket and a latch body are securely disposed at the upper end of the latch section for securely latching the latch section with the connection seat.

6 Claims, 22 Drawing Sheets

(56) References Cited

U.S. PATENT DOCUMENTS

| | | | | |
|---|---|---|---|---|
| 8,002,012 | B2 * | 8/2011 | Cheng | E06B 9/322 160/170 |
| 10,876,353 | B2 * | 12/2020 | Hummel | E06B 9/264 |
| 2005/0098274 | A1 * | 5/2005 | Nien | E06B 9/323 160/168.1 R |
| 2012/0073765 | A1 * | 3/2012 | Hontz | E06B 9/304 160/84.02 |
| 2013/0048234 | A1 * | 2/2013 | Dahl | E06B 9/388 160/171 |
| 2016/0053534 | A1 * | 2/2016 | Chang | E06B 9/304 160/168.1 P |
| 2016/0222722 | A1 * | 8/2016 | Schulman | E06B 9/68 |
| 2016/0326799 | A1 * | 11/2016 | Marocco | A47H 13/04 |
| 2017/0204657 | A1 * | 7/2017 | Wen | E06B 9/367 |
| 2018/0328108 | A1 * | 11/2018 | Chou | E06B 9/28 |
| 2018/0347269 | A1 * | 12/2018 | Wang | E06B 9/38 |
| 2019/0242186 | A1 * | 8/2019 | Chou | E06B 9/304 |

* cited by examiner

BLIND CORD GUIDE SEAT

BACKGROUND OF THE INVENTION

1. Field of the Invention

The present invention relates generally to a blind cord guide seat, and more particularly to a blind cord guide seat, which has a simplified structure and can be quickly installed.

2. Description of the Related Art

A conventional horizontal blind is such structurally designed that a slat control device and a pull cord control device are mounted in a U-shaped blind rail. The slat control device includes a fixing support mounted in the blind rail and a controlling polygonal drum supported on the fixing support. A square tube is fitted through the controlling polygonal drum and connected to a bead chain controlling seat. By means of pulling the bead chain, the square tube is controlled to rotate so as to drive the controlling polygonal drum to rotate and control the slats between a horizontal position for the sunlight to go in and a vertical position for shading the sunlight. The pull cord control device has a pull cord connected to a lower weight positioned at the lowermost end of the slats. The pull cord is passed through the respective slats and connected with a roller set disposed in the blind rail. After the direction of the pull cord is changed by the roller set, the pull cord is connected to a brake device. When the slats are lifted or lowered, the brake device serves to locate the slats in a fixed position. A pull cord is suspended from one side of the brake device, whereby a user can pull the pull cord to lift or lower the slats.

The conventional horizontal blind has numerous components. The cost for the horizontal blind is relatively high and it is complicated and troublesome to install the horizontal blind. Especially, all the components are mounted in the narrow internal space of the U-shaped blind rail. Therefore, it is quite complicated and time-costing to assemble and install the horizontal blind. Moreover, the power supply device of the conventional horizontal blind for controlling the lifting/lowering of the slats is generally controlled by a bead chain. All the components of the horizontal blind are mounted in the U-shaped blind rail so that the lifting/lowering of the slats can be only controlled by the bead chain as the power supply device without any other substitutive power supply device. This often causes trouble to the user.

In order to solve the problem of numerous components and high cost of the conventional horizontal blind, the inventor has disclosed a horizontal blind U.S. Ser. No. 15/890,282. In this patent, a cord restriction seat is used to truly separate the ladder belts, whereby the slats can be more vertically positioned to enhance the sunshade effect. In addition, the guide wheels disposed under the cord restriction seat serve to guide the slat pull cord and keep the slat pull cord in the middle of the slats. Accordingly, the slats can be more stably and smoothly lifted and collected or lowered and spread, whereby the horizontal blind can achieve better sunshade effect or permit the sunlight to go in.

However, according to the assembly of the cord restriction seat and the cord winding device of such horizontal blind, it is necessary to first pass the cord winding sleeve through the cord restriction seat and then lock the connection seat at the upper end of the cord restriction seat to block the opening of the cord restriction seat. Finally, the connection seat is locked under the blind rail by means of screws to locate the cord restriction seat.

After the cord restriction seat and the connection seat are connected, the cord winding sleeve is enclosed in the cord restriction seat. When replacing or repairing the cord winding sleeve, it is necessary to detach the connection seat from the cord restriction seat for taking out the cord winding sleeve. This is quite inconvenient and time-costing and will lead to increase of cost.

SUMMARY OF THE INVENTION

It is therefore a primary object of the present invention to provide a blind cord guide seat, which has a simplified structure and can be quickly installed or detached. The blind cord guide seat is designed to solve the problem of the conventional blind cord guide seat in installation and operation, whereby the installation process of the blind cord guide seat is simplified and speeded to lower the cost.

To achieve the above and other objects, the blind cord guide seat of the present invention includes:

a connection seat fixed under a blind rail, the connection seat having a base seat, two assembling seats extending from two sides of the base seat, a through hole being formed on an end face of each assembling seat for screws to pass through and lock the connection seat under the blind rail, two other sides of the base seat being respectively formed with two latch holes and two threaded holes for correspondingly assembling/connecting with a cord restriction seat; and a cord restriction seat connected under the connection seat, a rectangular window being formed on a bottom of the cord restriction seat, a fixing section and a latch section upward extending from the rectangular window, an outer face of the fixing section being formed with a belt guide channel, an outer face of the latch section being also formed with a belt guide channel, a top end of the fixing section being formed with threaded holes, screws being screwed into the threaded holes of the fixing section and the threaded holes of the connection seat to connect the fixing section with the connection seat, a latch body being disposed on an inner face of the top end of the latch section, an iron-made hook bracket being fixed with the top end of the latch section by screws, two latch plates being formed on an upper end of the iron-made hook bracket. When assembling the cord winding device, an external force is applied to the latch section to directly outward bias the latch section to provide a space for placing a cord winding device into the cord restriction seat. After the cord winding device is placed into the cord restriction seat, the latch body of the latch section is latched with the base seat of the connection seat and the two latch plates are respectively latched in the latch holes of the base seat of the connection seat, whereby the latch section is securely assembled and connected with the connection seat and the installation or detachment of the cord winding device is speeded and facilitated.

The present invention can be best understood through the following description and accompanying drawings, wherein:

DETAILED DESCRIPTION OF THE PREFERRED EMBODIMENTS

Figure 1:
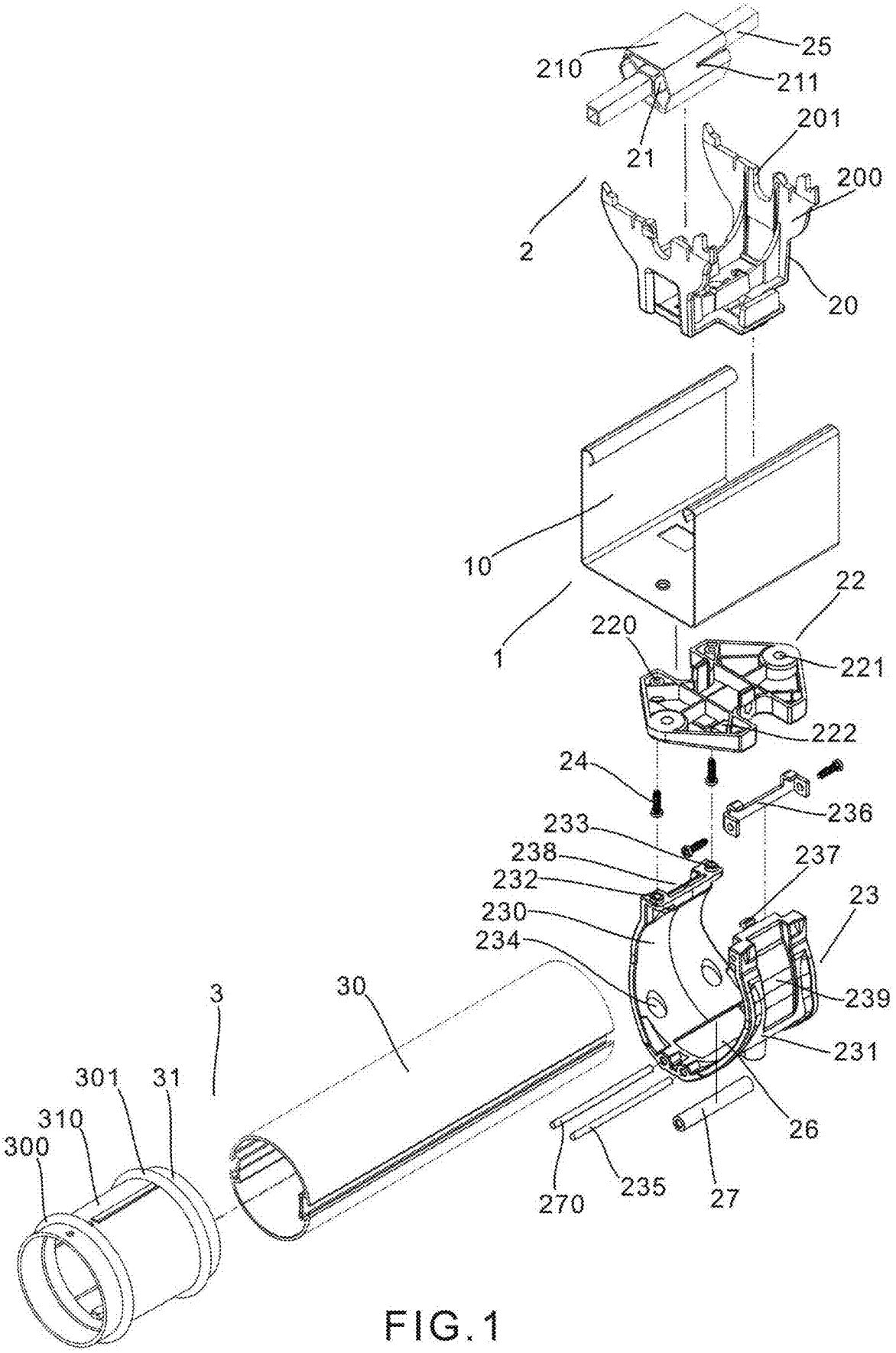
FIG. 1 is a perspective exploded view of the present invention.

Please refer to FIG. 1. The blind cord guide seat of the present invention is connected in a horizontal blind. The horizontal blind mainly includes a blind rail 1, more than one slat control device 2 and more than one cord winding device 3.

The blind rail 1 is a U-shaped structure (as shown in FIG. 1). The blind rail 1 can be affixed to a ceiling or an upper edge of a window by means of fixing brackets. The blind rail 1 has a recessed receiving space 10 for receiving the slat control device 2.

Figure 2:
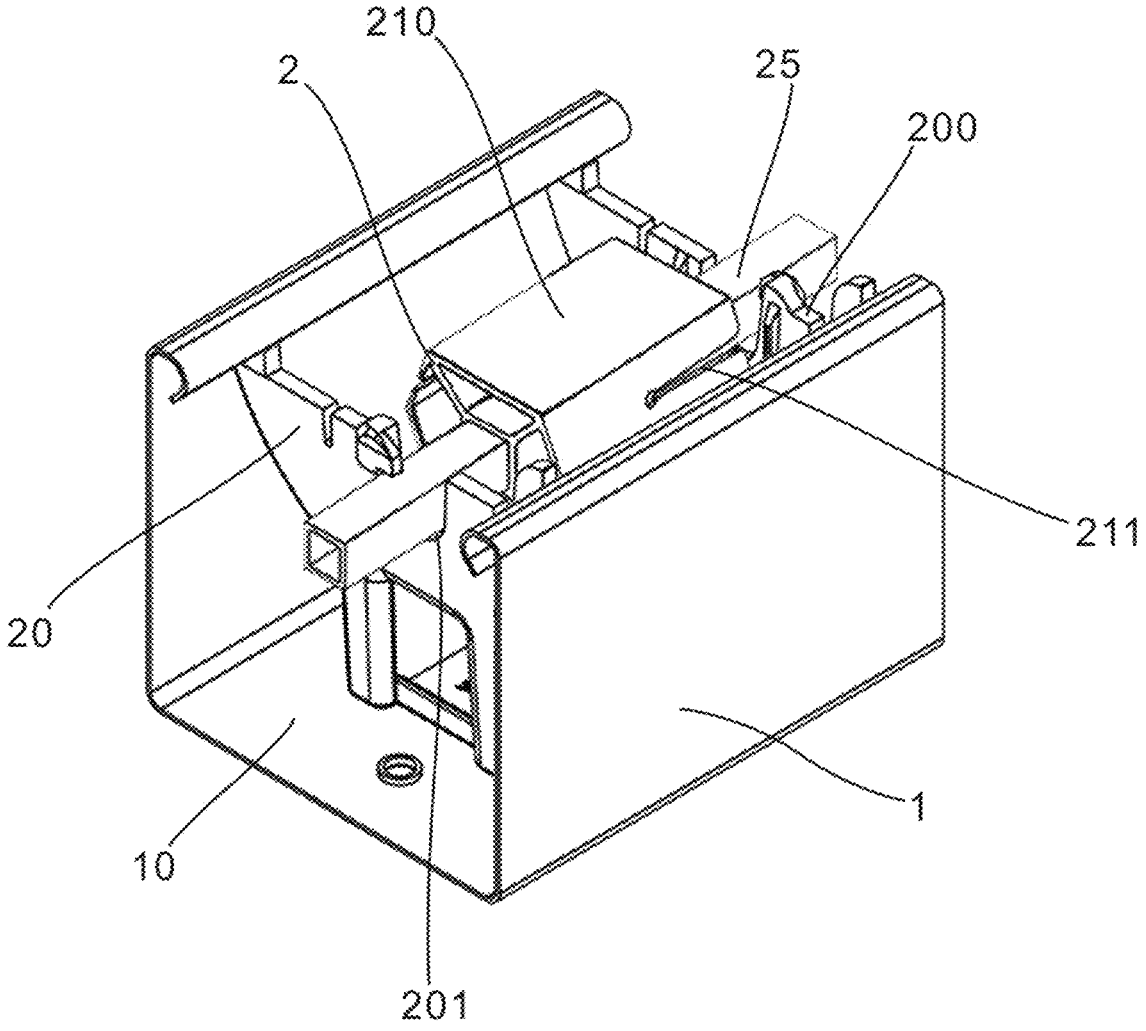
FIG. 2 is a perspective assembled view of the slat control device of the present invention.

Please refer to FIGS. 1 and 2. The slat control device 2 includes a locating support 20 connected in the receiving space 10 of the blind rail 1 and a controlling polygonal drum 21 disposed on the locating support 20 and a cord restriction seat 23 locked under the blind rail 1 via a connection seat 22.

Referring to FIGS. 1 and 2, two support boards 200 are disposed on two sides of the main body of the locating support 20 for supporting and mounting the locating support 20 in the blind rail 1. Each support board 200 is formed with an arched notch 201. In addition, the bottom of the locating support 20 is formed with two perforations. Two ladder belts are connected with the controlling polygonal drum 21 and extend downward through the perforations of the locating support 20 along the cord restriction seat 23 to connect with the respective slats.

A square tube 25 is fitted through the controlling polygonal drum 21 and rested in the arched notches 201 of two sides of the locating support 20. The square tube 25 is connected with a power supply device for driving the controlling polygonal drum 21 to rotate. The main body of the controlling polygonal drum 21 is a hexagonal body composed of six plane faces 210 connected with each other. Two opposite plane faces of the controlling polygonal drum 21 are formed with belt splits 211, in which the ladder belts are secured to downward extend.

Figure 3:
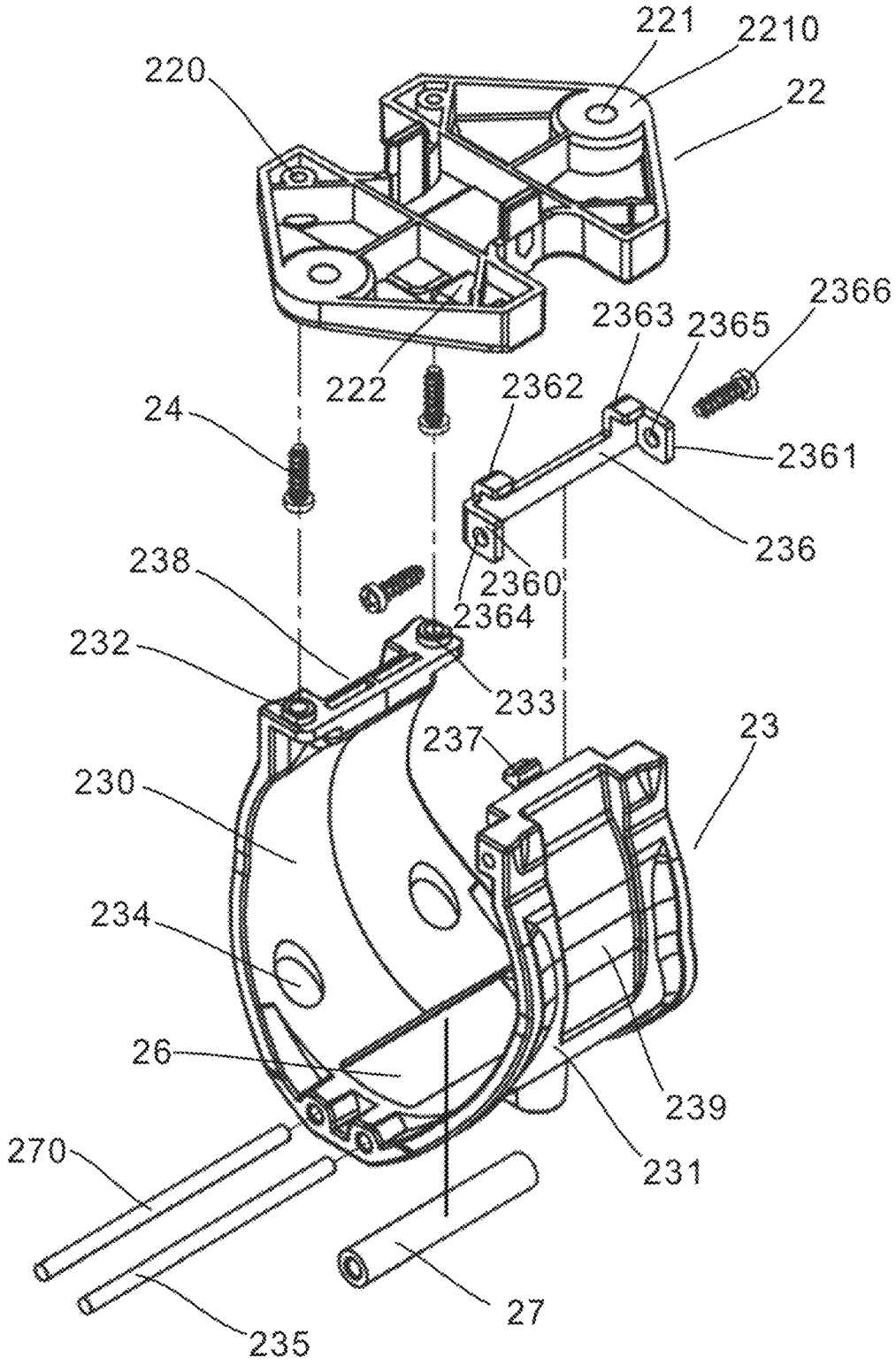
FIG. 3 is a perspective exploded view of the cord restriction seat of the slat control device of the present invention.
Figure 4:
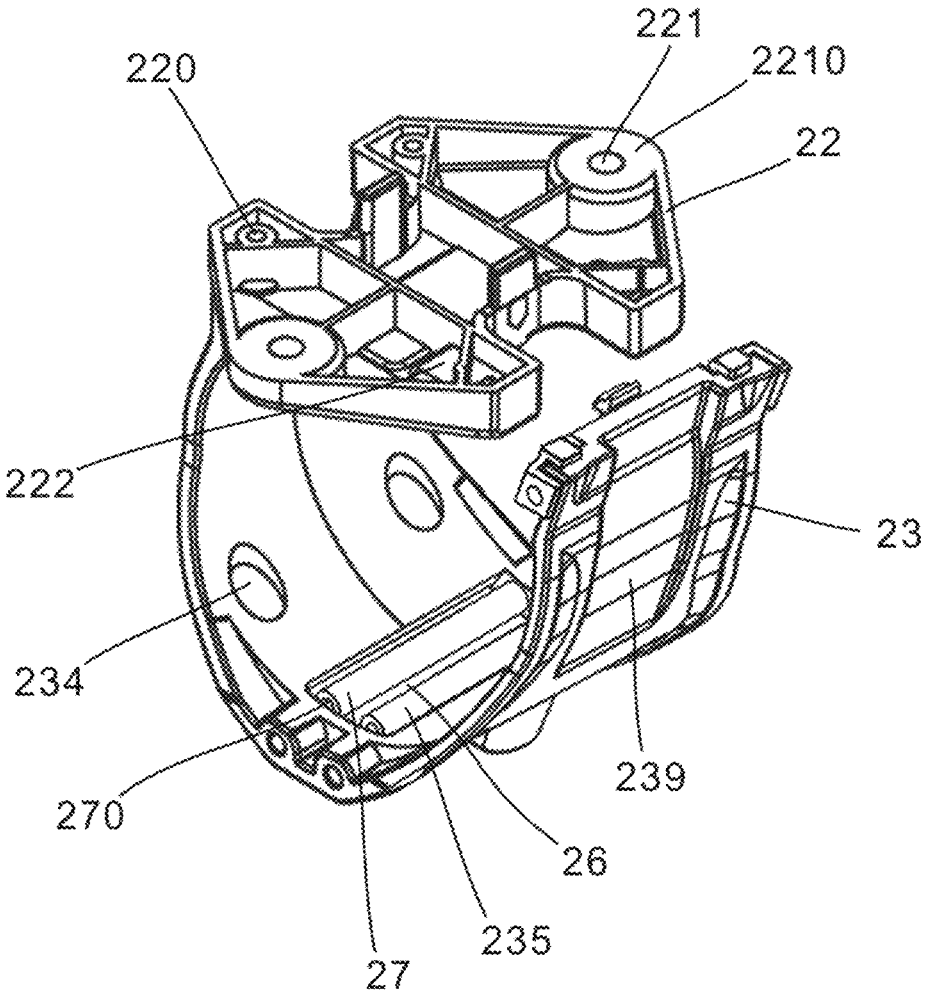
FIG. 4 is a perspective assembled view of the cord restriction seat of the slat control device of the present invention.
Figure 5:
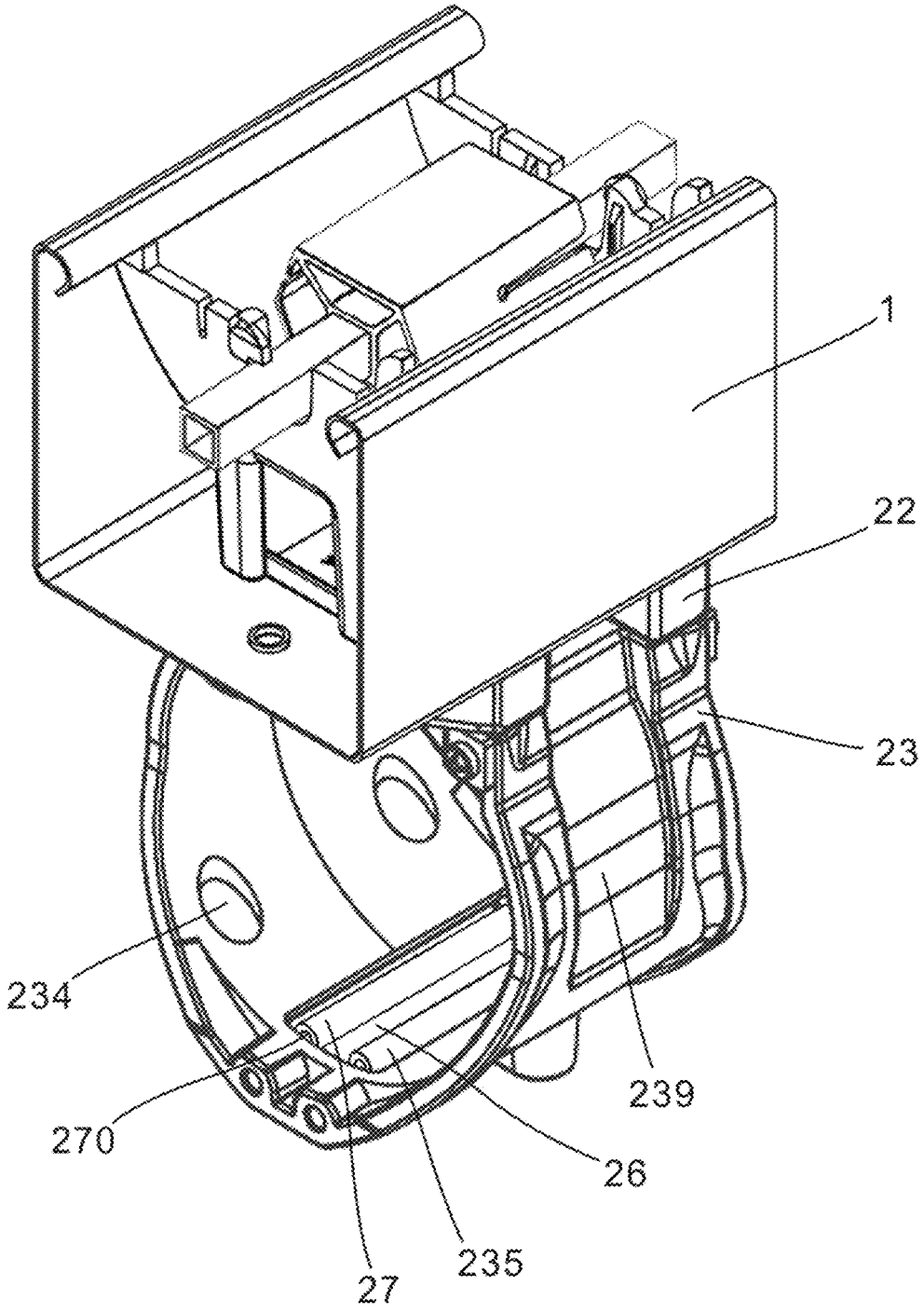
FIG. 5 is a perspective assembled view of the slat control device of the present invention.

Referring to FIGS. 3, 4 and 5, the cord guide seat includes a connection seat 22 and a cord restriction seat 23. The connection seat 22 includes a base seat. Two assembling seats 2210 extend from two sides of the base seat. A through hole 221 is formed on the end face of each assembling seat 2210. Two other sides of the base seat are respectively formed with two latch holes 222 and two threaded holes 220 for correspondingly assembling with the cord restriction seat 23. The cord restriction seat 23 is connected under the connection seat 22. A rectangular window 26 is formed on the bottom of the cord restriction seat 23. A fixing section 230 and a latch section 231 upward extend from the rectangular window 26, whereby the cord restriction seat 23 has the form of an integrated U-shaped body. The fixing section 230 is an arched structure. An outer face of the fixing section 230 is formed with a belt guide channel 238. Two sides of top end of the fixing section 230 are formed with threaded holes 232, 233. Screws 24 are passed through the through holes 234 formed on the wall face of the cord restriction seat 23 and screwed into the threaded holes 232, 233 and the threaded holes 220 of the connection seat 22 so as to integrally lock the cord restriction seat 23 under the connection seat 22. An outer face of the latch section 231 is also formed with a belt guide channel 239. An iron-made hook bracket 236 is locked on the upper end of the latch section 231. The hook bracket 236 has two lugs 2360, 2361 and two latch plates 2362, 2363. Each of the lugs 2360, 2361 is formed with a threaded hole 2364, 2365. Screws 2366 are screwed through the threaded hole 2364, 2365 to lock the iron-made hook bracket 236 on the top end of the latch section 231. A latch body 237 is disposed on an inner side of the latch section 231. The latch plates 2362, 2363 are latched in the latch holes 222 of the connection seat 22 and the latch body 237 is directly latched with the connection seat 22, whereby the latch section 231 is securely latched with the connection seat 22. More than one set of cord guide wheels is mounted in the rectangular window 26 formed on the bottom of the cord restriction seat 23. Each cord guide wheel is composed of a shaft rod 270, 235 and a roller 27 fitted on the shaft rod. Accordingly, the roller 27 can be rotated to guide the pull cord wound around the body of a movable conic tube 31 to downward extend through the respective slats and connect with the lower weight for controlling the collection/release of the slats. Finally, by means of the through holes 221 of the connection seat 22, the cord restriction seat 23 and the connection seat 22 are together securely locked under the blind rail 1 (as shown in FIG. 5).

Figure 6:
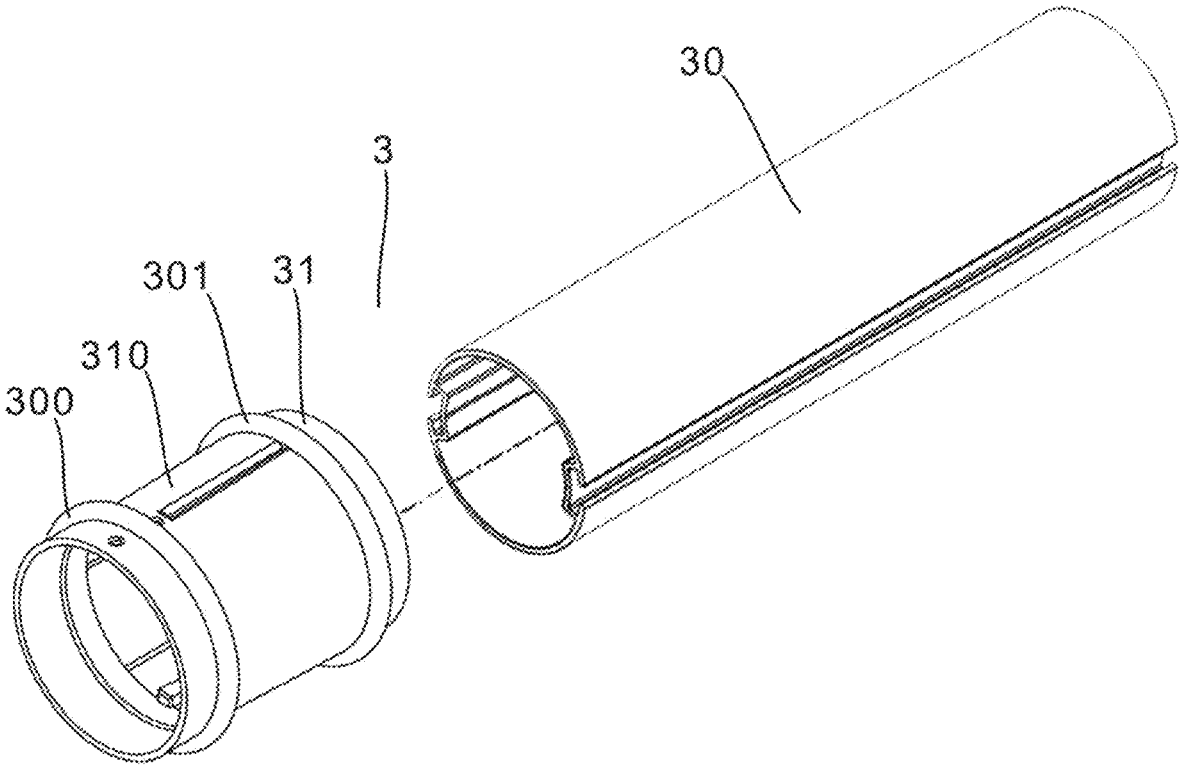
FIG. 6 is a perspective exploded view of the cord winding device of the present invention.
Figure 7:
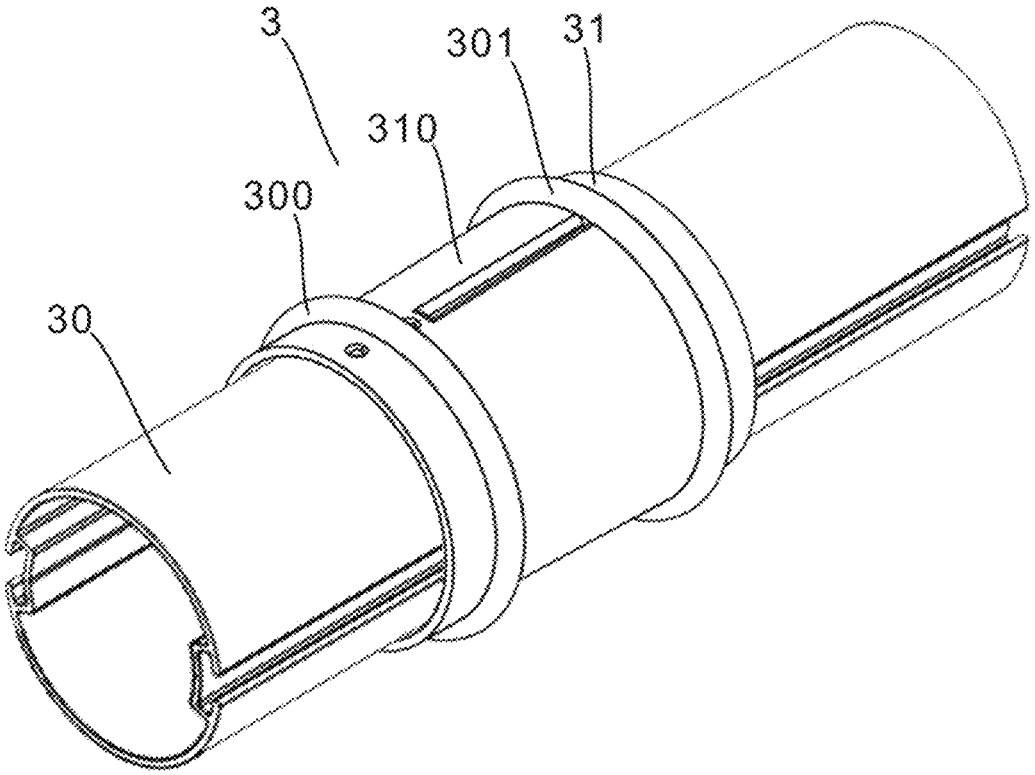
FIG. 7 is a perspective assembled view of the cord winding device of the present invention.
Figure 8:
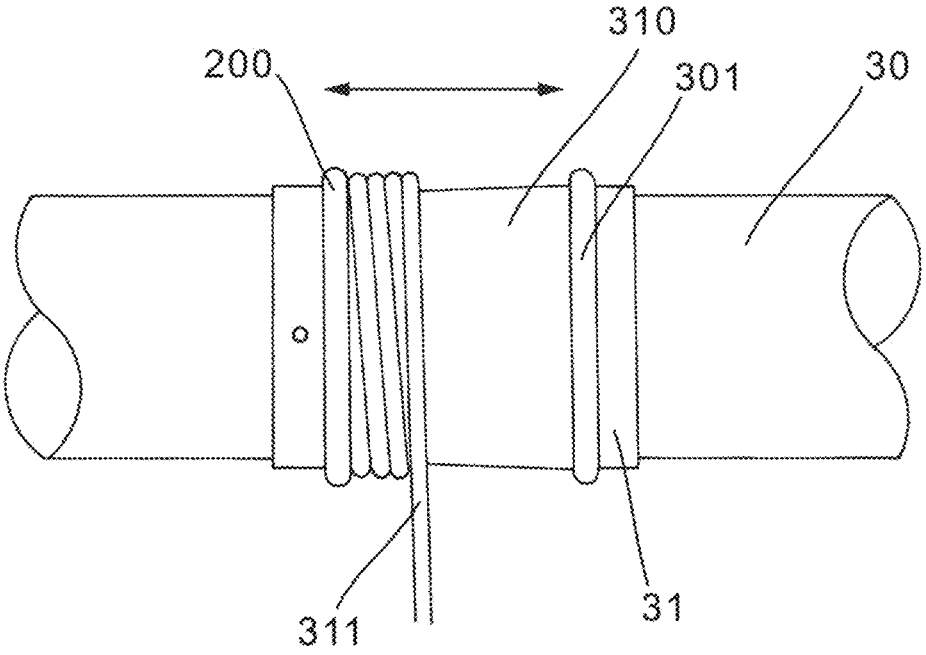
FIG. 8 is a view showing the operation of the cord winding device of the present invention.
Figure 9:
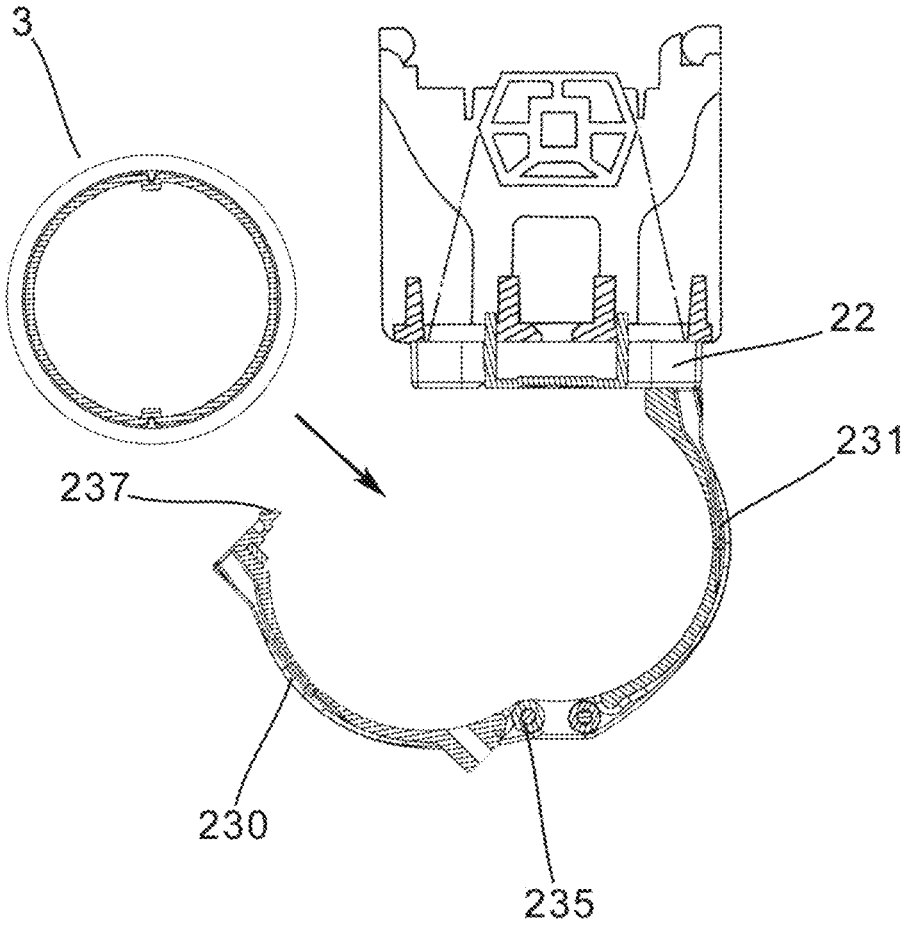
FIG. 9 is a view showing that the cord winding device and the slat control device of the present invention are assembled with each other.

Please refer to FIGS. 6 and 7. The cord winding device 3 includes a cord winding sleeve 30 and the movable conic tube 31 movably fitted on the cord winding sleeve 30. Two annular walls 300, 301 are formed at two ends of the movable conic tube 31, whereby the pull cord is restricted to be only wound around the body of the movable conic tube 31 between the two annular walls 300, 301. The body of the movable conic tube 31 is a tapered tubular body 310. The conic configuration of the tapered tubular body 310 serves to guide the pull cord 311 to be more tidily wound on the tapered tubular body 310 without tangling (as shown in FIG. 8).

Figure 10:
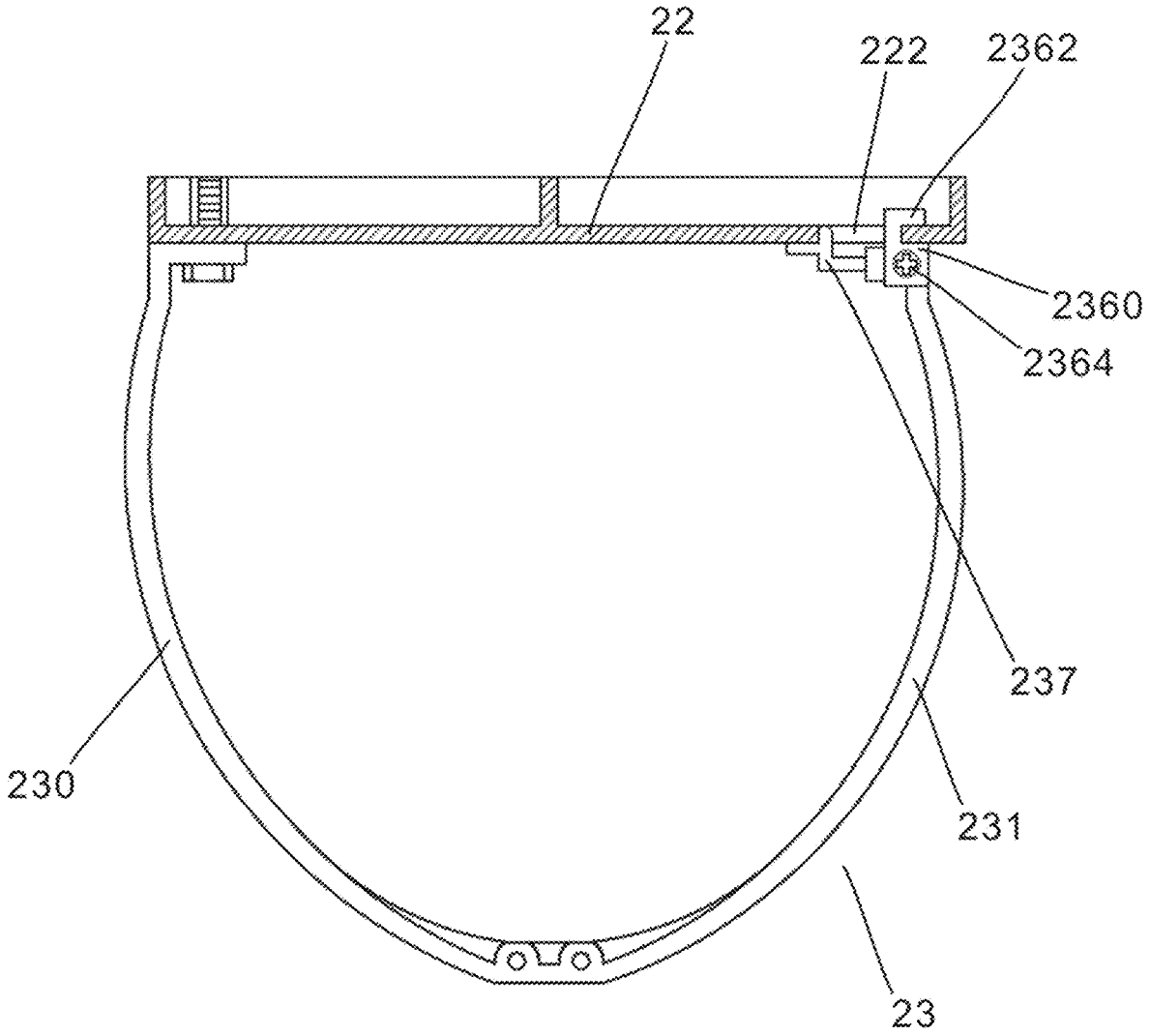
FIG. 10 is a sectional assembled view of the connection seat and the cord restriction seat of the present invention.
Figure 11:
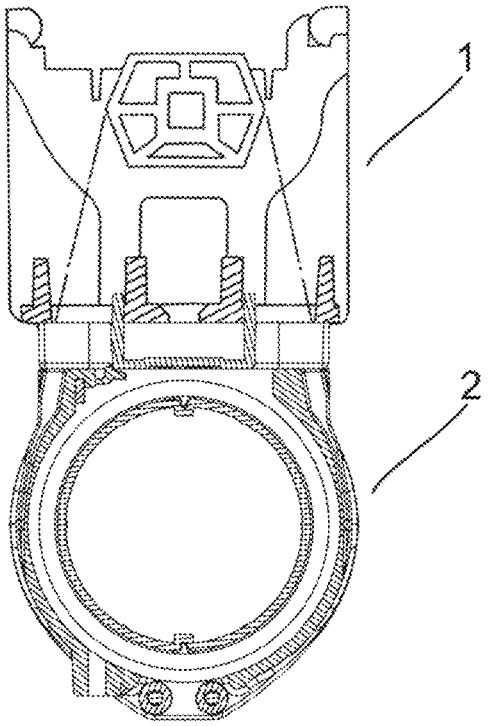
FIG. 11 is a sectional assembled view of the cord winding device and the slat control device of the present invention.
Figure 12:
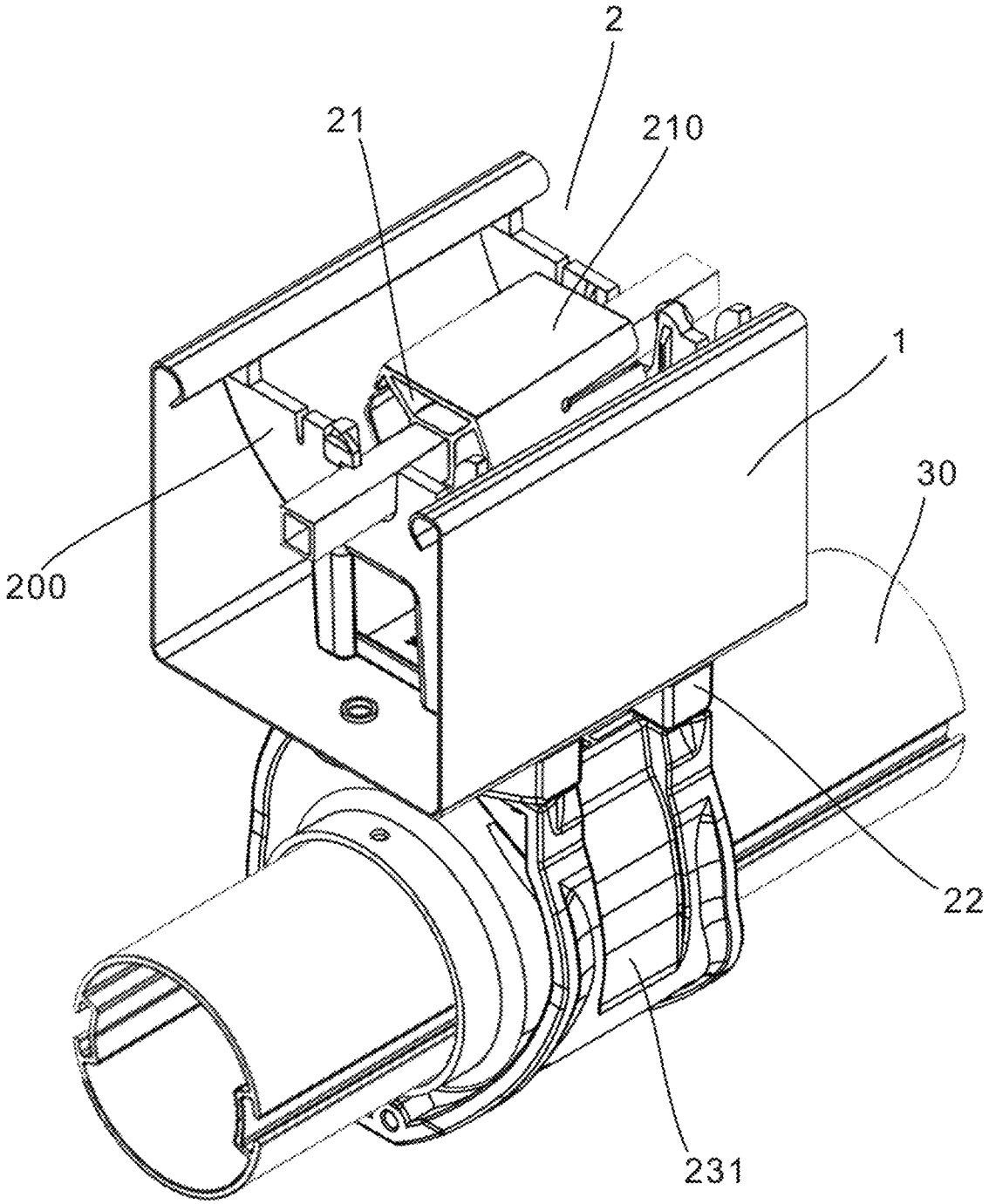
FIG. 12 is a perspective assembled view of the cord winding device and the slat control device of the present invention.
Figure 13:
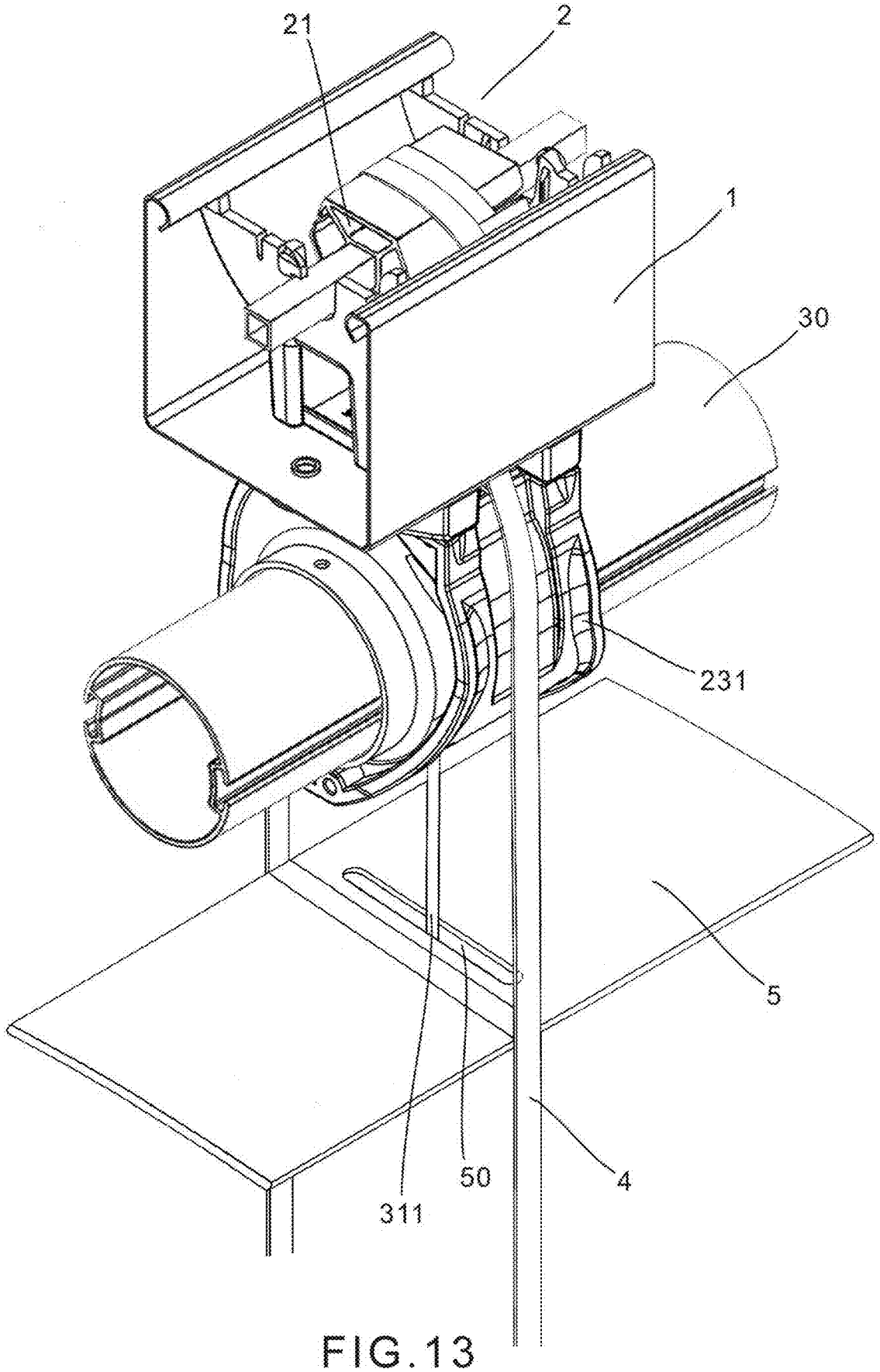
FIG. 13 is a perspective view of the complete assembly of the present invention.

Please refer to FIGS. 9, 19, 11, 12 and 13. The assembling process of the present invention is such that the slat control device 2 is locked under the blind rail 1. The fixing section 230 of the cord restriction seat 23 is connected with the connection seat 22 by means of the screws. Then, an external force is applied to the latch section 231 to outward bias the latch section 231 and provide an opening. Thereafter, the cord winding device 3 is placed through the opening into the cord restriction seat 23. Then the latch section 231 is restored to its home position. By means of the latch body 237 of the upper end of the latch section 231 and the two latch plates 2362, 2363, the latch section 231 is securely latched with the connection seat 22 to enclose the cord winding device 3 in the cord restriction seat 23 (as shown in FIG. 10). Thereafter, the two ladder belts 4 of the controlling polygonal drum 21 are downward conducted along the two belt guide channels 238, 239 to connect with two lateral ends of the respective slats 5. The pull cord 311 wound on the movable conic tube 31 of the cord winding device 3 is conducted along the inner face of the cord restriction seat 23 to pass through the rollers 27 out of the cord restriction seat 23. The pull cord 311 is guided by the rollers 27 and positioned at the center. The pull cord 311 is then sequentially passed through the holes 50 of the respective slats 5 to connect with the lower weight 51 at the bottom for controlling the upward collection/downward release of the slats 5. Then the blind rail 1 is connected with the fixing brackets for securely locking the entire set of horizontal blind under a ceiling or on an upper edge of a window to complete the installation of the horizontal blind (as shown in FIGS. 11, 12 and 13).

Figure 14:
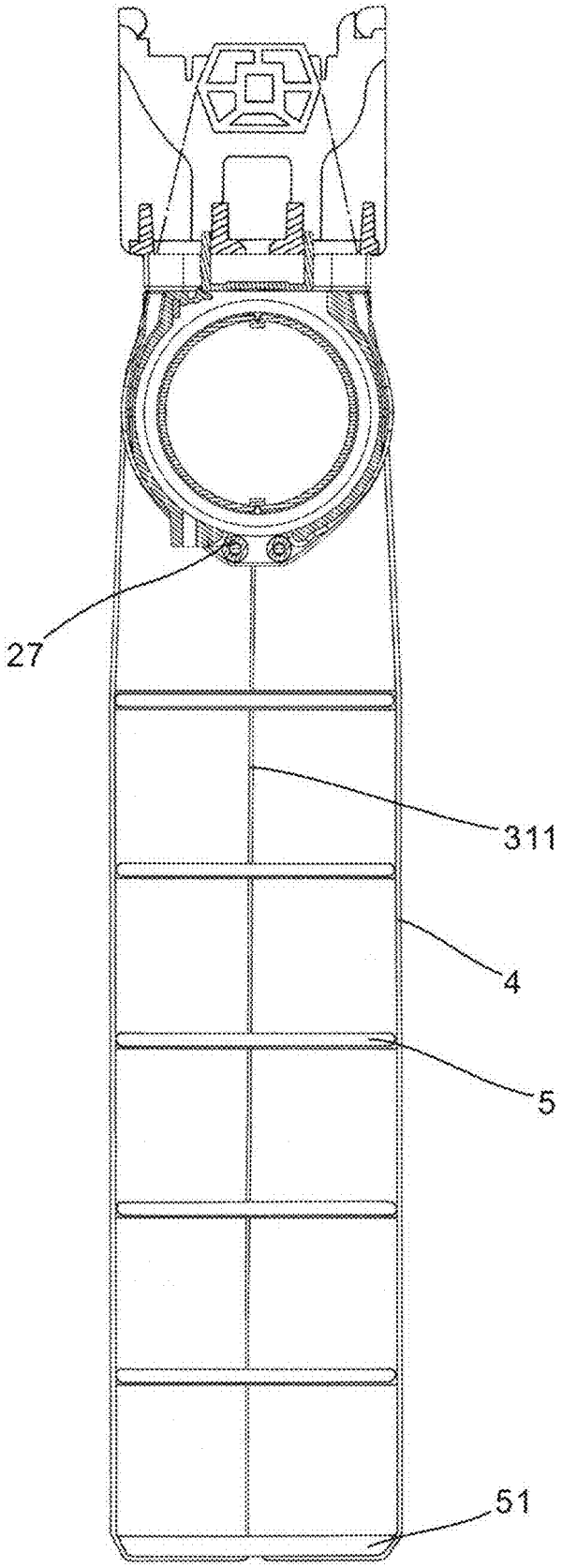
FIG. 14 is a view showing the installation of the slats of the present invention.
Figure 15:
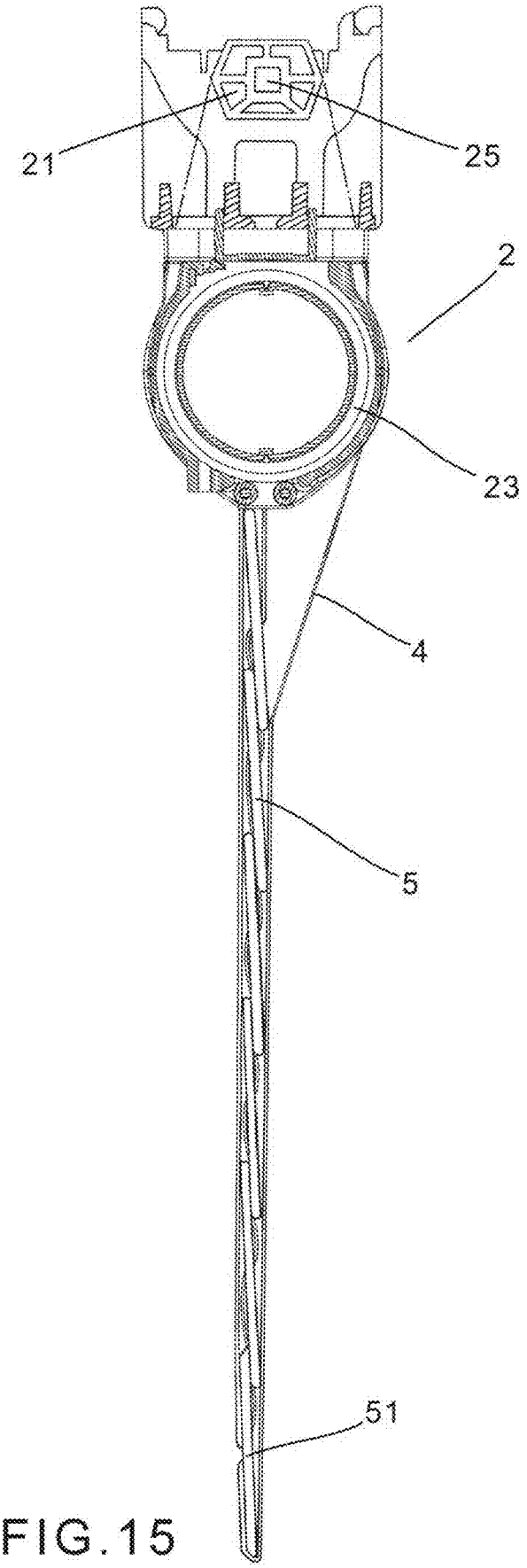
FIG. 15 is a view showing that the slats of the present invention are turned into a vertical position to shade the sunlight.

As shown in FIG. 14, when it is desired to shade the sunlight, the square tube 25 of the controlling polygonal drum 21 of the slat control device 2 is driven by the power supply device to rotate. At the same time, the controlling polygonal drum 21 is driven to rotate, whereby the ladder belts 4 pull up one side of the slats 5 and lower the other side of the slats 5. The ladder belts 4 are guided by the belt guide channels 238, 239 of the cord restriction seat 23, whereby the slats 5 are turned into a vertical position to shade the sunlight. At this time, the uppermost slat 5 will abut against the bottom end of the cord restriction seat 23 to make the slats 5 more snugly attach to each other so as to enhance the sunshade effect (as shown in FIG. 15).

Figure 16:
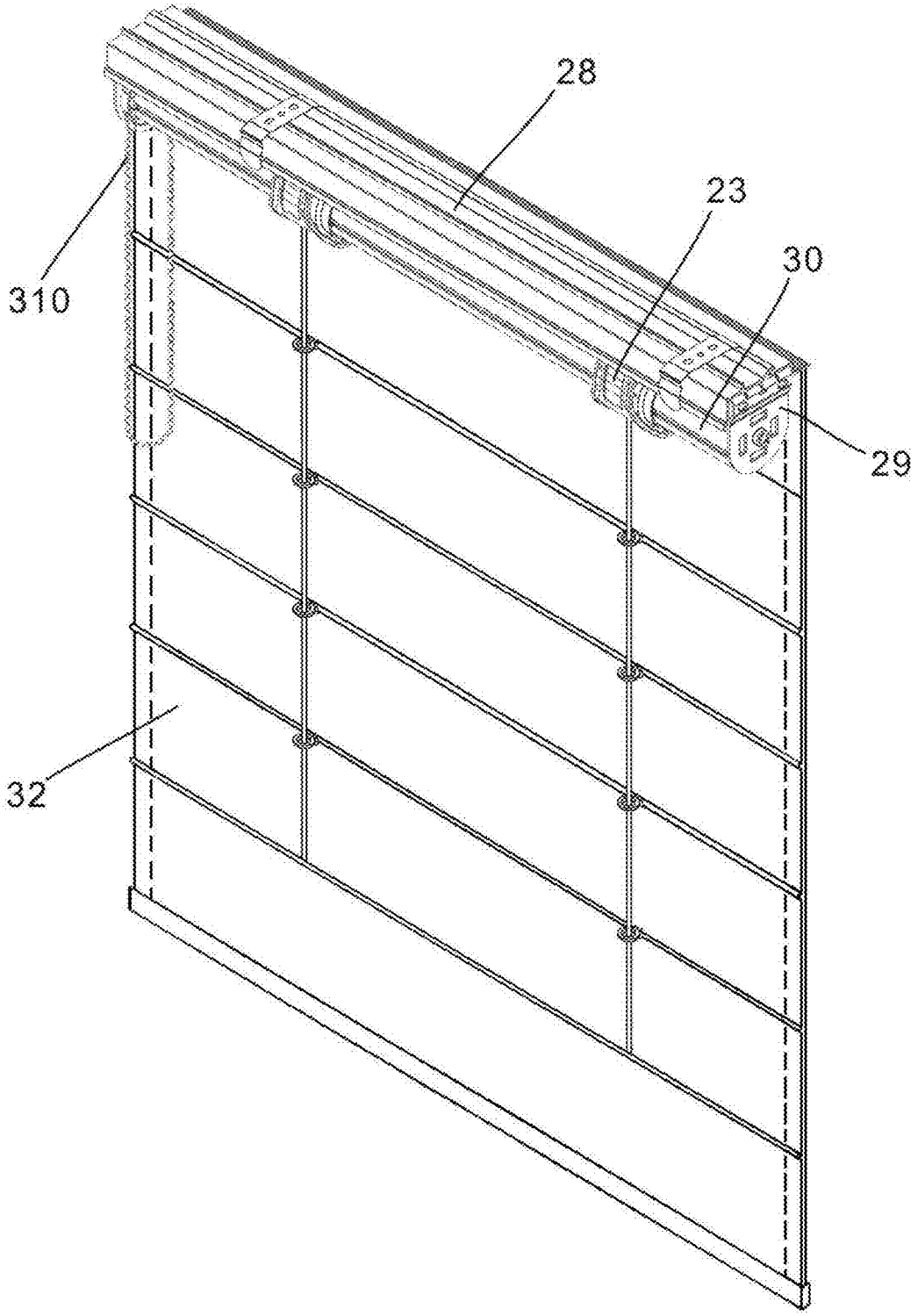
FIG. 16 is a perspective view of another embodiment of the present invention.
Figure 17:
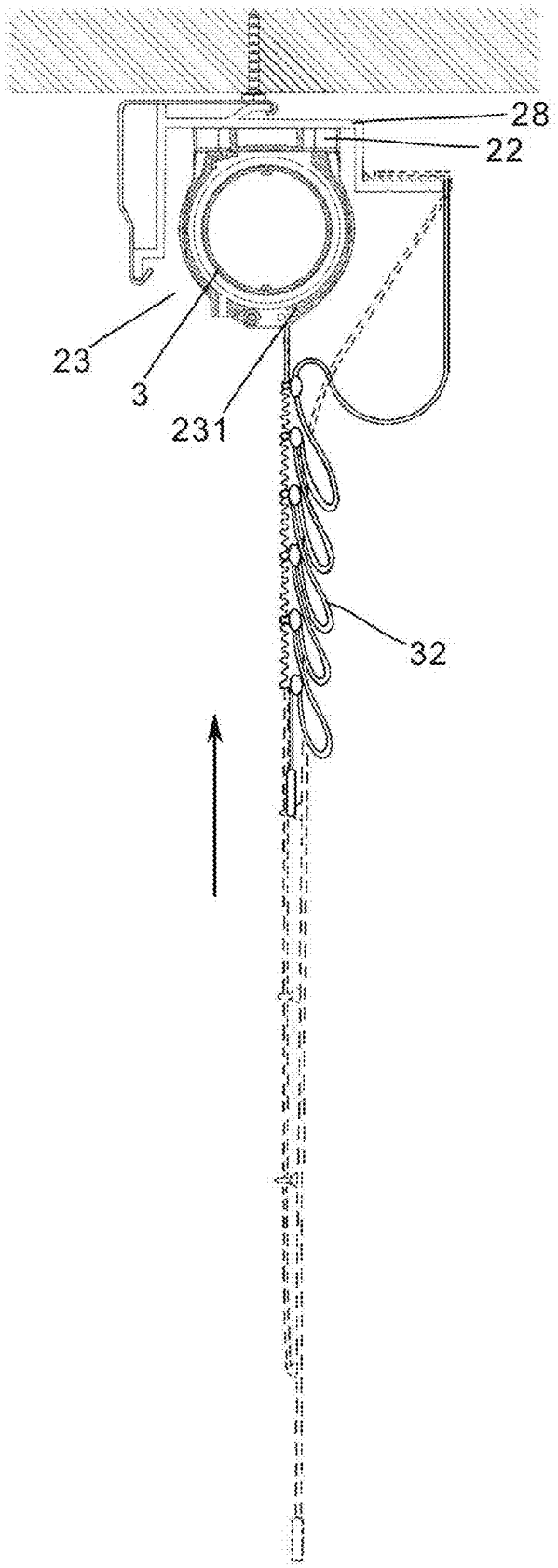
FIG. 17 is a sectional view of the other embodiment of the present invention.
Figure 18:
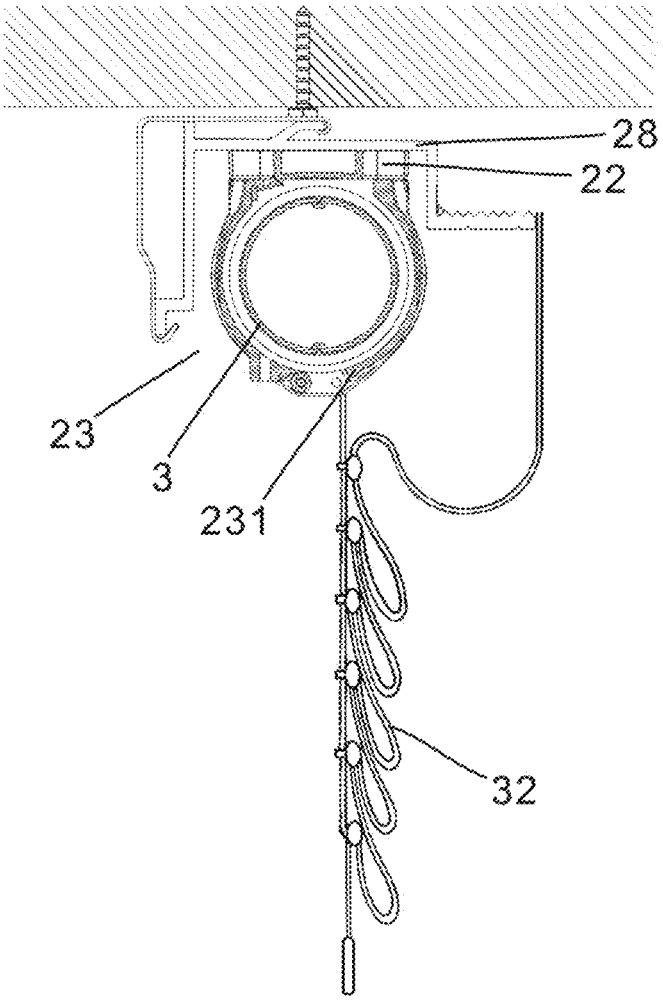
FIG. 18 is a sectional view of the other embodiment of the present invention, showing that the shade sheet is collected.

Please now refer to FIG. 16, which shows that the present invention is applied to a Roman shade. In this embodiment, the fixing section 230 of the cord restriction seat 23 is integrally securely connected with the connection seat 22 by means of screws 24. Then the connection seat 22 and the cord restriction seat 23 are locked under the blind rail 28 by means of screws. Then the latch section 231 is outward biased to provide an opening. Thereafter, the cord winding device 3 is placed through the opening into the cord restriction seat 23. Two fixing brackets 29 are respectively mounted on two sides of the blind rail 28 for mounting the cord winding sleeve 30. The cord winding sleeve 30 is controlled by a pull cord controller 310 to rotate. The pull cord wound around the movable conic tube 31 on the cord winding sleeve 30 is suspended to connect with the shade sheet to complete the installation of the Roman shade.

Figure 19:
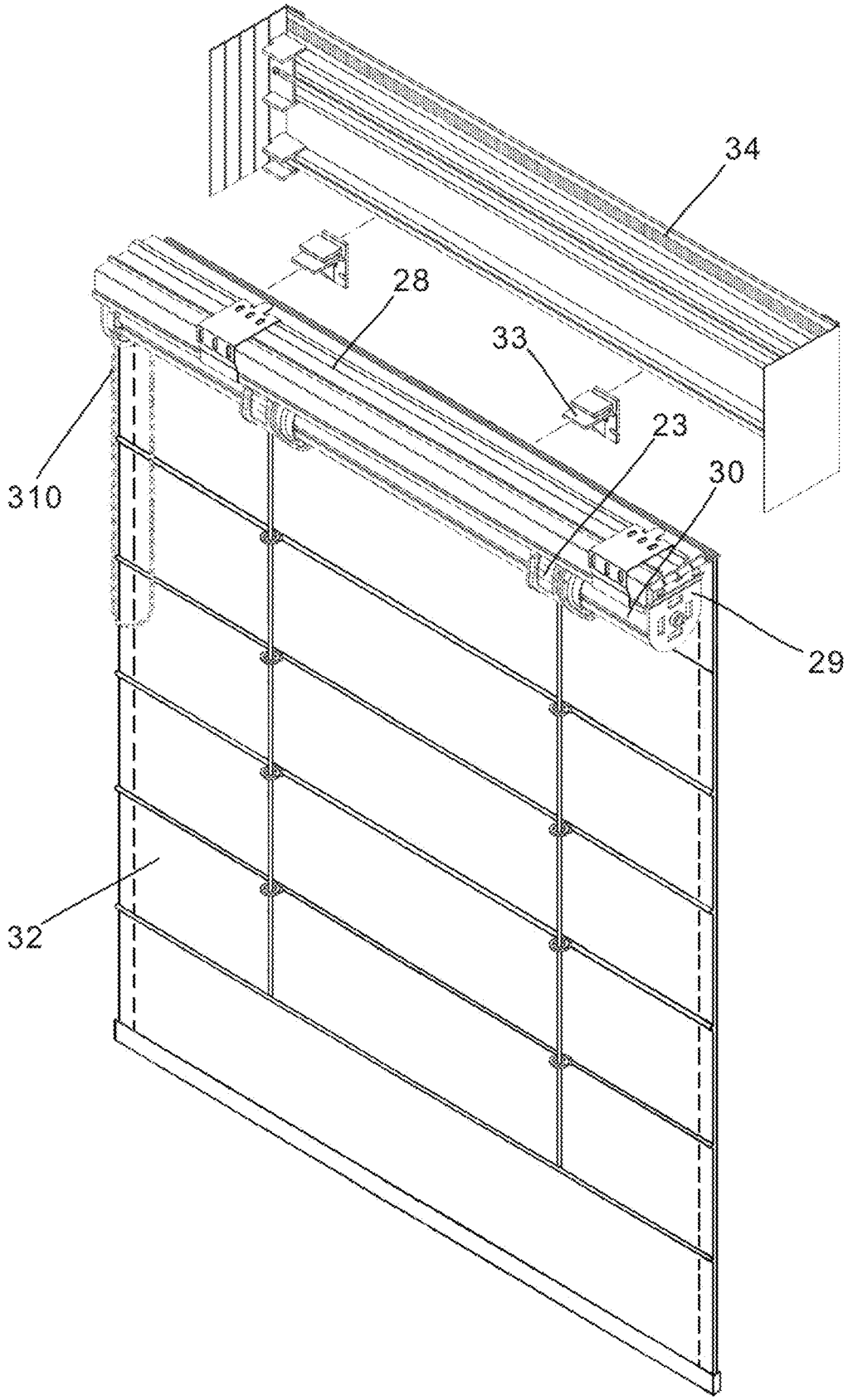
FIG. 19 is a perspective view of the other embodiment of the present invention, showing that a decorative board is to be mounted on the blind rail.
Figure 20:
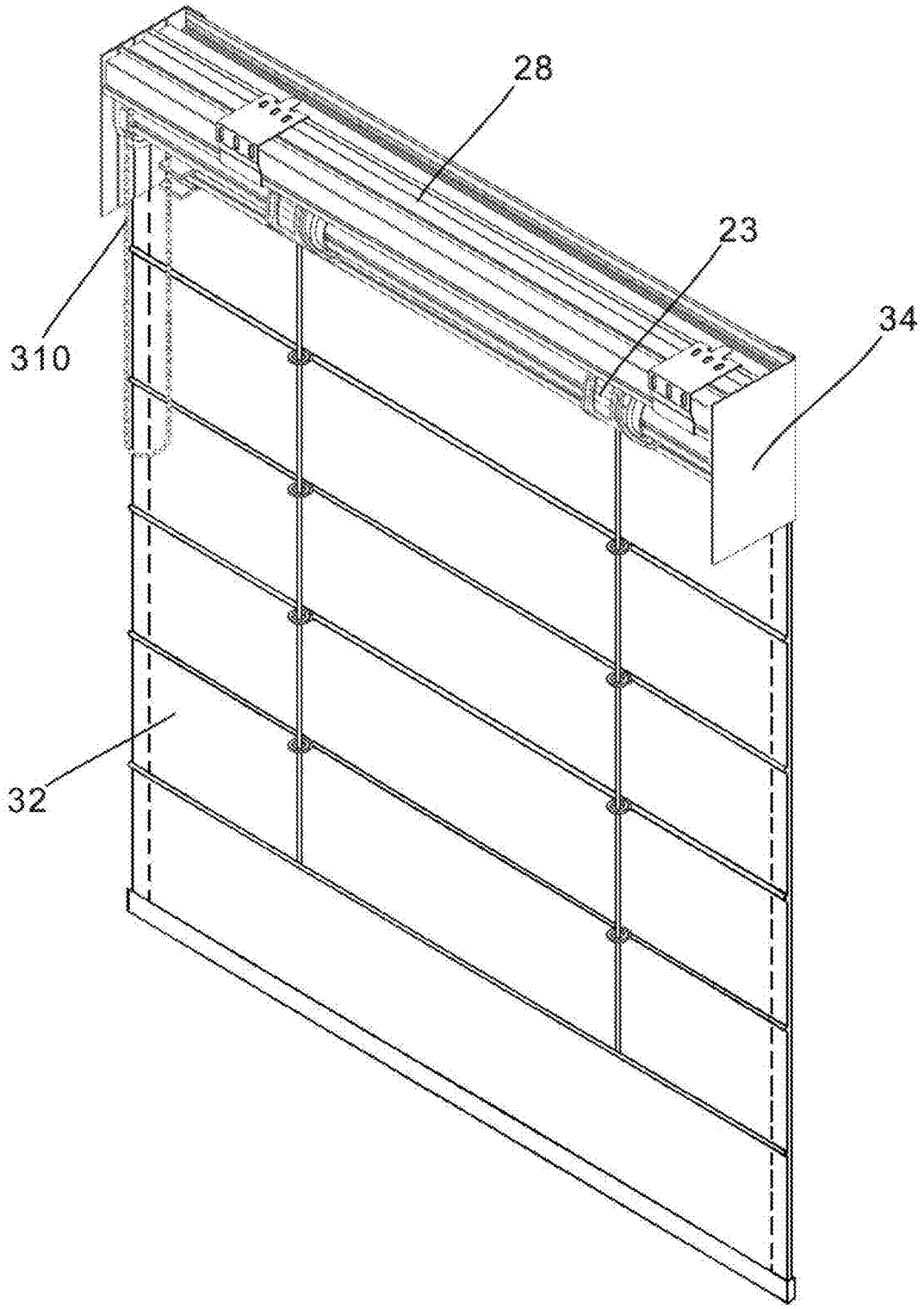
FIG. 20 is a perspective view of the other embodiment of the present invention, showing that a decorative board is mounted on the blind rail.

The pull cord controller 310 is pulled downward to drive the cord winding sleeve 30 to rotate so as to collect or release the shade sheet 32 for shading the sunlight or permitting the sunlight to go in. In addition, in order to beautify the appearance, a decorative board 34 is mounted by means of fixing brackets 33 to conceal the blind rail so as to beautify the appearance of the Roman shade (as shown in FIGS. 19 and 20).

Figure 21:
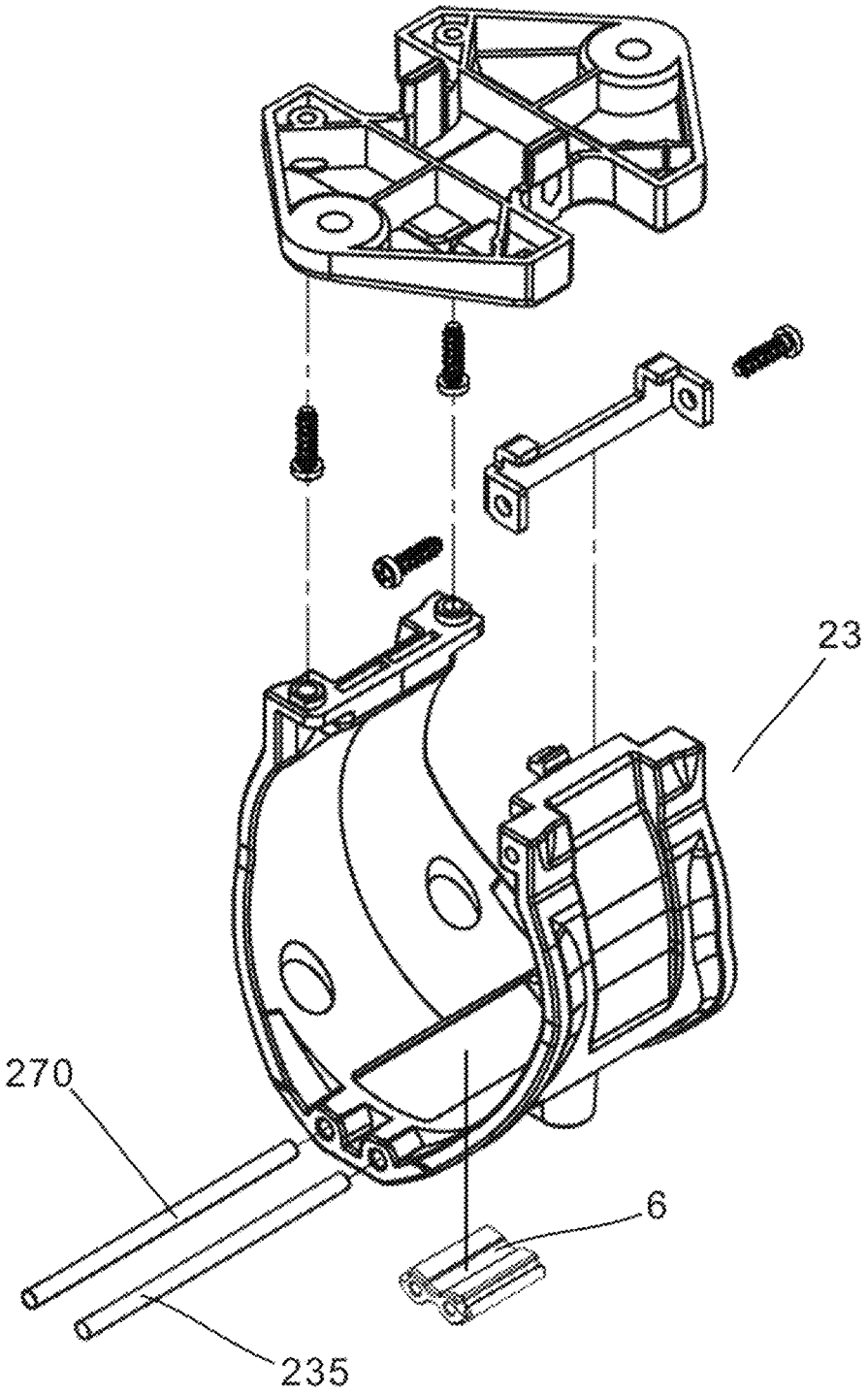
FIG. 21 is a perspective exploded view of another embodiment of the cord guide wheel of the present invention.
Figure 22:
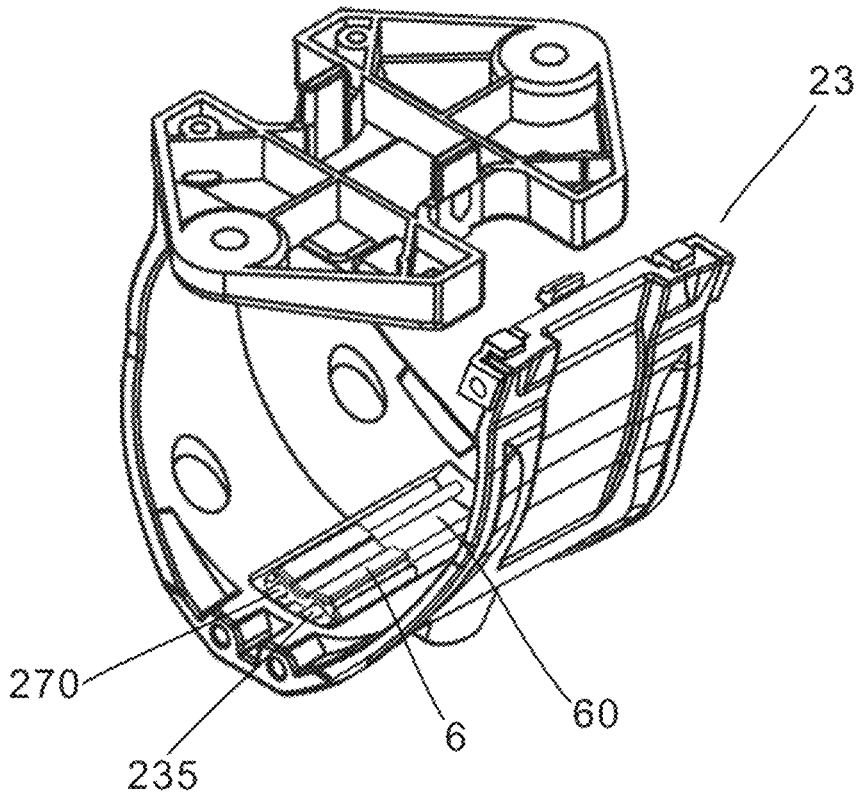
FIG. 22 is a perspective assembled view of the other embodiment of the cord guide wheel of the present invention.

Please further refer to FIGS. 21 and 22, which show another embodiment of the cord guide wheel disposed in the rectangular window of the bottom of the cord restriction seat 23. In this embodiment, a collar member 6 is fitted on the shaft rods 270, 235. The collar member 6 can be left and right moved to provide through hole 60, 61. The pull cord 311 can be conducted through the through hole 60, 61 to connect with the lower weight without compressing the slats.

The above embodiments are only used to illustrate the present invention, not intended to limit the scope thereof. Many modifications of the above embodiments can be made without departing from the spirit of the present invention.

What is claimed is:

1. A blind cord guide seat comprising:

a connection seat fixed under a blind rail, the connection seat having a base seat, two assembling seats extending from two sides of the base seat, a through hole being formed on an end face of each assembling seat for screws to pass through and lock the connection seat under the blind rail, two other sides of the base seat being respectively formed with two latch holes and two threaded holes for correspondingly assembling/connecting with a cord restriction seat; and a cord restriction seat connected under the connection seat, a rectangular window being formed on a bottom of the cord restriction seat, a fixing section and a latch section upward extending from the rectangular window, an outer face of the fixing section being formed with a belt guide channel, an outer face of the latch section being also formed with a belt guide channel, a top end of the fixing section being formed with threaded holes, screws being screwed into the threaded holes of the fixing section and the threaded holes of the connection seat to connect the fixing section with the connection seat, a latch body being disposed on an inner face of the top end of the latch section, an iron-made hook bracket being fixed with the top end of the latch section by screws, two latch plates being formed on an upper end of the iron-made hook bracket, whereby an external force is applied to the latch section to outward bias the latch section to provide a space for placing a cord winding device into the cord restriction seat, after the cord winding device is placed into the cord restriction seat, the latch body of the latch section being latched with the base seat of the connection seat and the two latch plates being respectively latched in the latch holes of the base seat of the connection seat, whereby the latch section is securely assembled and connected with the connection seat and the installation or detachment of the cord winding device is speeded and facilitated.

2. The blind cord guide seat as claimed in claim 1, wherein the iron-made hook bracket includes a bracket body, two lugs and two latch plates, each lug being formed with a threaded hole.

3. The blind cord guide seat as claimed in claim 1, wherein the fixing section and the latch section of the cord restriction seat are arched structures.

4. The blind cord guide seat as claimed in claim 1, wherein the latch body protrudes from the inner face of the latch section and includes a support section and an oblique top body disposed on upper side of the support section.

5. The blind cord guide seat as claimed in claim 1, wherein two cord guide wheels are further disposed in the rectangular window of the bottom of the cord restriction seat.

6. The blind cord guide seat as claimed in claim 1, wherein a collar member is disposed in the rectangular window of the bottom of the cord restriction seat, the collar member being left and right movable to provide a through hole in the rectangular window.

* * * * *